United States Patent [19]

Takemura et al.

[11] 4,010,793

[45] Mar. 8, 1977

[54] METHOD FOR CHANGING WIDTH OF CAST SLABS DURING CONTINUOUS CASTING

[75] Inventors: Yozo Takemura, Tokai; Kouich Hirayama, Cita; Yoshiyuki Kikuci, Tokai, all of Japan

[73] Assignee: Nippon Steel Corporation, Tokyo, Japan

[22] Filed: Oct. 29, 1975

[21] Appl. No.: 626,639

[30] Foreign Application Priority Data

Nov. 8, 1974 Japan ..... 49-128748

[52] U.S. Cl. ..... 164/82; 164/280

[51] Int. Cl.[2] ..... B22D 11/04

[58] Field of Search ..... 164/82, 83, 89, 280

[56] References Cited

UNITED STATES PATENTS

| | | | |
|---|---|---|---|
| 3,049,769 | 8/1962 | Schultz | 164/273 R |
| 3,292,216 | 12/1966 | Colombo | 164/281 |
| 3,612,150 | 10/1971 | Rossi | 164/82 |
| 3,717,197 | 2/1973 | Strock et al. | 164/280 X |
| 3,913,658 | 10/1975 | Schmid | 164/280 |
| 3,926,244 | 12/1975 | Meier et al. | 164/82 X |

*Primary Examiner*—Ronald J. Shore

*Attorney, Agent, or Firm*—Toren, McGeady and Stanger

[57] ABSTRACT

A method for changing a steel slab width during continuous casting of the steel slab, which comprises moving at least one side member of a mold at a speed not higher than 2.0 mm/second during the continuous casting.

3 Claims, 2 Drawing Figures

METHOD FOR CHANGING WIDTH OF CAST SLABS DURING CONTINUOUS CASTING

BACKGROUND OF THE INVENTION

According to a conventional art for increasing the width of steel slabs during continuous casting, pouring of molten steel into a casting mold is stopped and after the molten steel is drawn from the mold as a cast slab, one or both side (shorter) members composing the mold is moved then a dummy bar having a width corresponding to the increased width is put in the bottom of the mold and the molten steel is poured again into the mold to obtain steel slab having increased or decreased width.

Therefore the conventional art has defects such that the casting operation must be completely stopped each time for changing the slab width, and a considerable time is required before the restoration of casting operation, thus causing remarkable lowering of continuous casting productivity.

SUMMARY OF THE INVENTION

The present invention has its object to eliminate the defects of the conventional art, and the feature of the present invention lies in moving the side member of the mold at a speed not higher than 2.0 mm per second during the continuous casting.

DETAILED DESCRIPTION OF THE INVENTION

Figure 1:
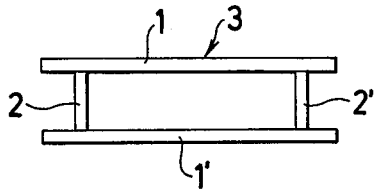

The present invention will be described in detail with reference to the accompanying drawing, in which:

FIG. 1 is a planar view of a mold for continuous casting.

Figure 2:
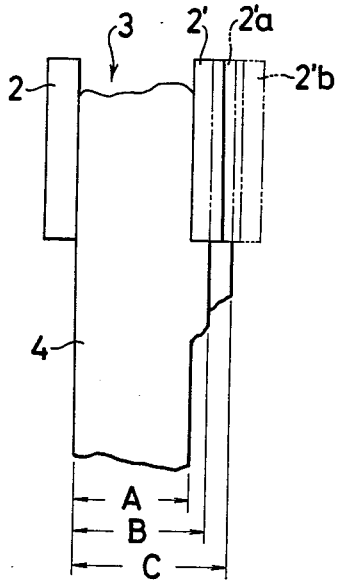

FIG. 2 explains the principle of the method for changing the width of steel slabs during the continuous casting.

The continuous casting generally comprises continuously pouring molten steel into a mold 3 which is composed of front (longer) members 1, 1' and side (shorter) members 2, 2', and allowing partial solidification of the molten steel and continuously drawing the molten steel from the lower portion of the mold as steel slab.

However, according to the conventional art for changing the width of the steel slab, one or both of the side members 2, 2' of the mold 3 is moved while the pouring of the molten steel is completely stopped after the molten steel has been drawn as steel slab, and a dummy bar is placed at the bottom portion of the mold. Thus the defects as mentioned above have been confronted with by the conventional art.

According to the present invention, one or both of the side members is moved during the continuous casting without stopping the pouring of the molten steel into the mold so that the mold width, namely the slab width is changed during the continuous casting operation.

The present inventors have found that the speed of the movement of the side member is critical for obtaining satisfactory results, and when the movement speed is higher than about 2.0 mm per second, solidification of the molten steel contacting the side member of the mold is not enough for preventing leakage of the molten steel, namely dangerous break-out.

The desired movement speed for avoiding the break-out is about 2.0 mm per second or lower and may be expressed by the following formula in relation with the casting speed and the slab thickness $$V \leq \frac{9.7 \times 10^{-3}}{\sqrt{\nu} \times W}$$

in which

V = average movement speed (m/min.) of the side member of the mold.

$\nu$ = casting speed (m/min.) during the movement of the side member.

W = slab thickness (m) during casting.

In this way, the slab width can be increased or decreased during the continuous casting operation with good results.

For safer operation, it is preferable that the casting speed (slab drawing speed) is not higher than about 0.5 m/min. or cool agents such as iron powder and pieces are added to the molten steel closest to the side member so as to forcedly cooling the molten steel closest to the side member of the mold, thereby the slab width can be changed during the continuous casting consistently and with a higher level of safety.

In FIG. 2 which shows the principle of the present invention, the molten steel is poured into the mold 3 and a steel slab having a predetermined width A is continuously cast. For increasing the slab width A during the continuous casting, the side member 2' of the mold 3 is moved to the postions of 2'a 2'b . . . at a speed not higher than 2.0 mm/sec. so that the slab width is increased to B, C . . . and a desired final slab width is obtained.

The present invention will be more clearly understood from the following examples.

EXAMPLE 1

A low-carbon Al-killed molten steel containing 0.04% C, 0.01% Si, 0.35% Mn, 0.01% P, 0.01% S, 0.06% Al with the balance being iron was poured into a mold of a continuous casting machine of curved type (10R) to continuously cast a steel slab of 1800 mm width and 250 mm thickness at a drawing speed of 1.0 m/minute, and for increasing the slab width to 1840 mm, both of the side members were moved outwardly at a speed of 0.1 mm/second continuously for 200 seconds while the casting was continuously done. The result was very satisfactory, and the slab width was increased safely and accurately.

EXAMPLE 2

For increasing the slab width to 1840 mm during the continuous casting under the same conditions as in Example 1. The casting speed (drawing rate) was lowered to 0.5 m/minute and both of the side members were moved outward at a speed of 1.2 mm/second so as to increase the slab width to 1840 mm. The result was that the slab width could be increased accurately as in Example 1 and subsequently the casting speed was restored to 1.0 m/minute to continue the casting operation with good result.

EXAMPLE 3

Molten steel containing 0.15% C, 0.25% Si, 1.3% Mn, 0.015% P, 0.005% S, 0.025% Al, with the balance being iron was poured into the mold of the continuous casting machine as used in Example 1, and cast into a steel slab of 1500 mm width and 245 mm thickness at a casting speed of 0.7 m/minute. For increasing the slab width to 2100 mm, the casting speed was lowered to 0.3 m/second, and iron powder as cooling agent was added to the molten steel closest to the side members in a rate of 50 g/second, and both of the side members were moved outward at a speed of 2.0 mm/second for 150 seconds while the casting was continued. The result was that the slab width could be increased accurately and subsequently the casting speed was restored to 0.7 m/minute to continue the casting with good results.

What is claimed is:

1. A method of changing the width of a steel slab formed in a continuous casting operation in which molten metal is poured into one end of a mold and the slab is withdrawn continuously from the other end of the mold and which mold includes two longer front members and two shorter side members with the front members defining the width surface of the slab being formed and the side surfaces defining the thickness surface of the slab being formed with the side members extending between the front members and defining the opposite ends of the width surface, wherein the improvement comprises moving at least one of the side members relative to the front members at a speed not greater than 2.0 mm/second while continuing to pour the molten metal into the mold and to withdraw the slab from the mold for effecting a significant change in the width of the slab being formed.

2. A method according to claim 1, in which the steel slab is drawn from the mold at a speed of not higher than about 0.5 m/minute during the movement of the side member.

3. A method of changing a steel slab width during continuous casting of the steel slab which comprises moving at least one side member of a mold at a speed not higher than 2.0 mm/second during the continuous casting, and adding a cooling agent to the molten steel contained in the mold and closest to the side member during the movement of the side member.

* * * * *